US006112461A

United States Patent [19]

Cheng

[11] Patent Number: 6,112,461

[45] Date of Patent: Sep. 5, 2000

[54] SAFETY GATE FOR CHILDREN

[76] Inventor: Shu-Chen Cheng, 3rd Fl., No. 100, Wenlin N. Rd., Taipei, Taiwan

[21] Appl. No.: 09/329,206

[22] Filed: Jun. 10, 1999

[30] Foreign Application Priority Data

Jul. 8, 1998 [TW] Taiwan ..... 87211081

[51] Int. Cl.[7] ..... E06B 3/68; E06B 7/00; E06B 9/01; E05C 21/02

[52] U.S. Cl. ..... 49/55; 292/DIG. 12; 49/57; 49/465

[58] Field of Search ..... 49/50, 55, 57, 49/395, 463, 465; 160/210, 215; 292/36, 40, 173, 167, DIG. 12

[56] References Cited

U.S. PATENT DOCUMENTS

| | | | |
|---|---|---|---|
| 4,583,715 | 4/1986 | Wright | 49/55 X |
| 4,611,431 | 9/1986 | Lauro | 49/55 |
| 5,117,585 | 6/1992 | Andrisin, III | 49/55 |
| 5,272,840 | 12/1993 | Knoedler et al. | 49/55 X |
| 5,396,732 | 3/1995 | Andersen | 49/55 |
| 5,442,881 | 8/1995 | Asbach et al. | 49/55 X |
| 5,535,552 | 7/1996 | Stern | 49/55 X |
| 5,683,123 | 11/1997 | Rouss | 49/57 X |
| 5,809,694 | 9/1998 | Postans | 49/57 |

FOREIGN PATENT DOCUMENTS

| | | | |
|---|---|---|---|
| 2193992 | 2/1988 | United Kingdom | 49/57 |
| 2234281 | 1/1991 | United Kingdom | 49/57 |

*Primary Examiner*—Daniel P. Stodola
*Assistant Examiner*—Hugh B. Thompson
*Attorney, Agent, or Firm*—Dellett and Walters

[57] ABSTRACT

A safety gate for a doorframe, which is able to prevent small children from going into a restricted or dangerous area, has a lock that requires two different and independent steps to proceed the unlock process. Furthermore, after the lock is unlocked, the user still needs to lift the plate body before the pivotal movement of the plate body with respect to the first side bar is possible.

12 Claims, 11 Drawing Sheets

SAFETY GATE FOR CHILDREN

BACKGROUND OF THE INVENTION

1. Field of the Invention

The present invention relates to a safety gate for children and especially for a safety gate having a locking device provided therein, so as that the safety gate is able to protect the children from accidentally going into a restricted or dangerous area.

2. Description of Related Art

As shown in FIG. 11, a conventional safety gate (50) for children is shown. The safety gate (50) normally has a first plate body (52) detachably engaged with a side of the doorframe and a second plate body (54) slidably engaged with the first plate body (52). The first plate body (52) has a lock (56) provided to secure the movement of the second plate body (54) with respect to the first plate body (52) and a plurality of protrusions (58) formed on a side face thereof, such that when the first plate body (52) engages with the side of the doorframe, the protrusions (58) are able to be received in the corresponding recesses (not shown) in the doorframe to secure the engagement therebetween. With such an arrangement, the safety gate (50) does prevent small children from going into a restricted or dangerous area and is able to expand to different widths to accommodate different doorframes.

However, if the children are tall enough to reach the lock (56), the lock (56) might be accidentally unlocked, and either the first plate body (52) or the second plate body (54) will be opened, which will compromise the integrity and usefulness of the gate (50).

Because the existing safety gate cannot fully protect children from accidentally going into a restricted or dangerous area, it is necessary to provide an improvement or modification to the safety gate to overcome the aforementioned problems. Therefore the present invention aims to provide an improved safety gate for children. The safety gate requires two different steps be disengaged from the doorframe, so that the safety of the children protected by the safety gate is enhanced.

SUMMARY OF THE INVENTION

The main object of the present invention is to provide a safety gate having a lock device provided therein so as to secure the movement between the plate bodies of the safety gate. Because unlocking the lock requires two different steps, even the children tall enough to reach for the lock device still cannot open the safety gate without the second step.

In order to meet the above objective, the safety gate has a plate body, a base detachably engaged with the plate body, a first side bar detachably engaged with the plate body, a second plate body pivotally engaged with the plate body and a lock provided in the plate body. The lock has a holding bar pivotally connected between the plate body and a hollow housing provided with a first stud and a second stud, a linkage eccentrically connected with the distal end of the holding bar in the housing, a lever a first distal end of which detachably connects with the linkage and a second distal end of which is detachably received in a seat defined in a side face of the second side bar, a handle rotatably connected with the housing, a driving block securely engaged with the handle, a latch slidably received between the housing and a recess in the second side bar and securely engaged with the driving block.

Another object of the invention depends on an expanding plate. The expanding plate is detachably connected between the plate body and the second side bar, such that the safety gate of the invention is suitable for all sizes of doors.

The detailed features of the present invention will be apparent in the detailed description with appropriate reference to the accompanying drawings.

DETAILED DESCRIPTION OF PREFERRED EMBODIMENT

Figure 1:
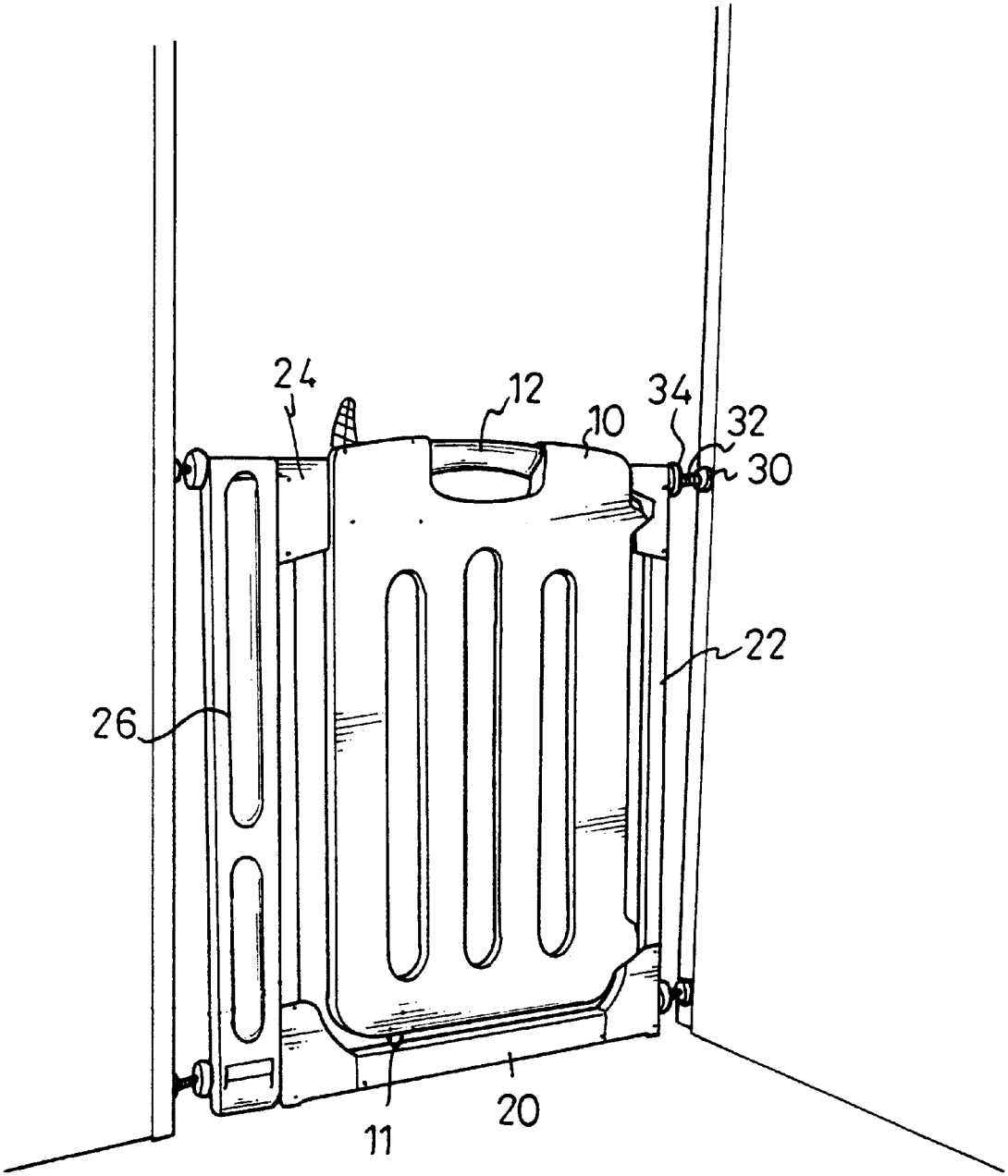
FIG. 1 is a perspective view of a safety gate in accordance with the present invention, wherein an expanding plate is attached therewith so as to adapt to different widths of doors.
Figure 2:
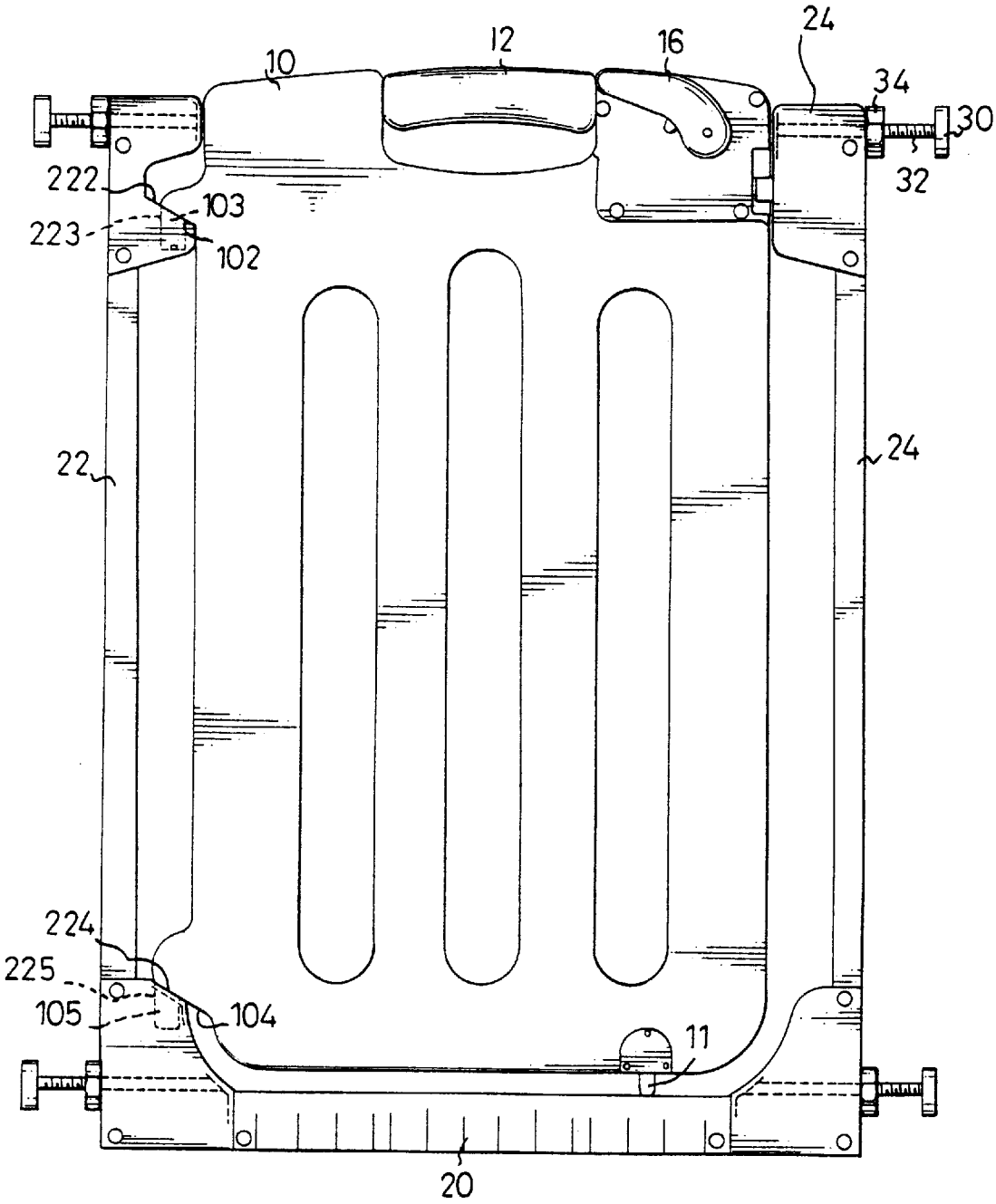
FIG. 2 is a rear view of the safety gate of FIG. 1, wherein the expanding plate is removed therefrom.

The present invention relates to a safety gate. As shown in FIGS. 1 and 2, the safety gate has a plate body (10), a base (20) detachably engaged with the plate body (10), a first side bar (22) detachably engaged with the plate body (10), a second side bar (24) pivotally engaged with the plate body (10) and a lock provided in the plate body (10). The plate body (10) has two opposed inclined faces (102, 104) respectively formed on the side connected with the first side bar (22) and each of the inclined faces (102, 104) has a downward extending lug (103, 105) formed thereon. The first and second side bars (22, 24) are securely connected with the base (20), and each has a pair of adjusting devices (30) securely connected therewith. The adjusting device (30) has two bolts (32) securely inserted into the first and the second side bars (22, 24) and a nut (34) threadingly movable on the bolt (34). By adjusting the bolts (32) of one pair of adjusting devices (30) on the second side bar (24) or both pairs of adjusting devices (30) on the first and second side bars (22, 24) respectively, the safety gate in accordance with the invention is able to adapt to different widths of doorframes (not shown). Moreover, The first side bar (22) has a pair of inclined faces (222, 224) respectively formed to correspond to each of the inclined faces (102, 104) and a pair of recesses (223, 225) respectively defined in each of the inclined faces (222, 224) and corresponding to the lugs (103, 105) respectively.

Figure 7:
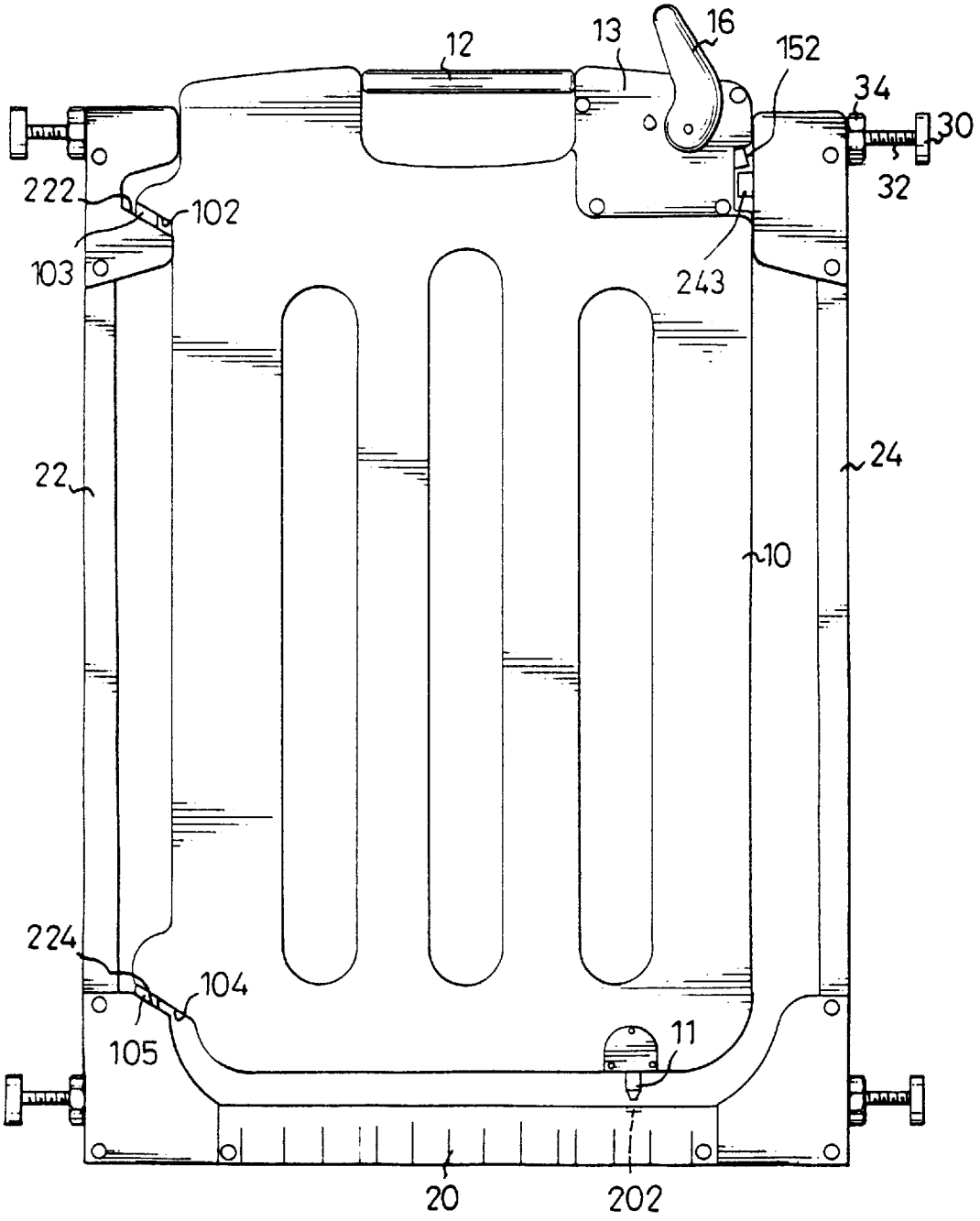
FIG. 7 is a rear view of the gate in FIG. 1 showing the disengagement between a plate body and a base.
Figure 8:
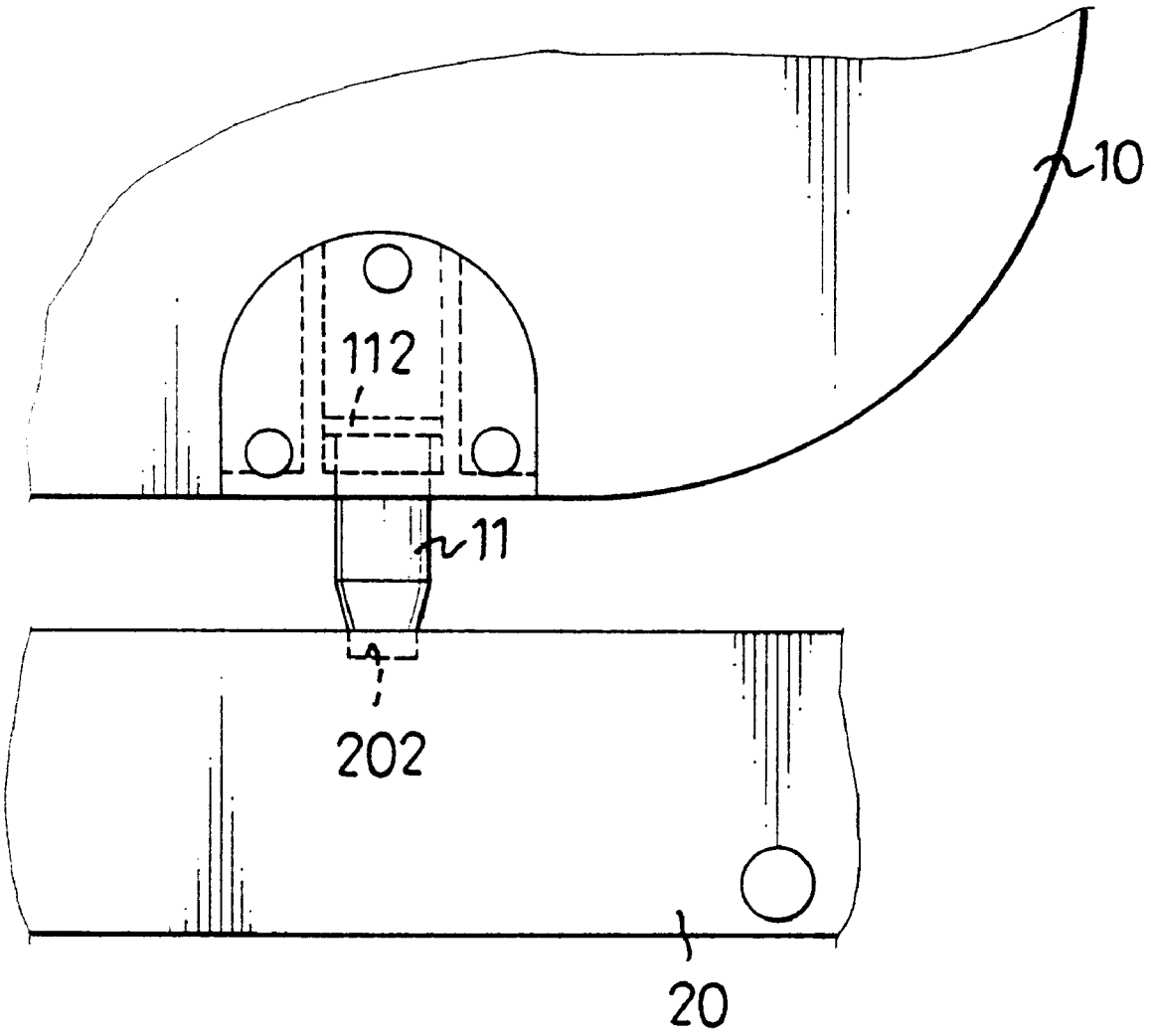
FIG. 8 is a enlarged plan view showing the engagement between the plate body and the base of the gate in FIG. 7.

Moreover, the pair of recesses (223, 225) are offset with each other and the lugs (103, 105) are also offset with each other, such that after the lugs (103, 105) are respectively received in the corresponding recesses (223, 225), the plate body (10) is able to pivot with respect to the first side bar (22). However, in order to prevent the plate body (10) from being pivotal with respect to the first side bar (22) at all times, a protrusion (11) is formed on the bottom of the plate body (10) and the base (20) has a corresponding slot (202), as shown in FIG. 7, so that when the protrusion (11) is received in the slot (202), the plate body (10) is fixed with respect to the base (20).

Referring to FIG. 3 and again taking FIG. 2 as reference, the safety gate of the invention has a lock provided therein. The lock has a holding bar (12) pivotally connected between the plate body (10) and a hollow housing (13) provided with a first stud (132) and a second stud (134) integrally formed on the inner face thereof and inconjunction with the plate body (10) forms a casing, a linkage (14) connected with the distal end of the holding bar (12) in the housing (13) in an eccentric manner, a lever (15) a first distal end of which detachably connects with the linkage (14) and a second distal end of which is detachably received in a seat (242) defined in a side face of the second side bar (24), a handle (16) having a stud (162) rotatably connected with the housing, a driving block (17) securely engaged with the stud (162) of the handle (16), a latch (18) slidably received between the housing (13) and a recess (244) in the second side bar (24) and securely engaged with the driving block (17). A first distal end (122) of the holding bar (12) is pivotally received in the plate body (10) and the second distal end (124) of the holding bar (12) is pivotally received in the housing (13) and has a slit (126) eccentrically defined therein. Furthermore, a first spring (128) is stretchably received between the second distal end (124) of the holding bar (12) and the housing (13), such that when the holding bar (12) is pivoted, the first spring (128) is able to provide the necessary recovery force to the holding bar (12) to return it to its original position. The linkage (14) has a key (142) corresponding to the slit (126) of the second distal end (124) of the holding bar (12). The key (142) is able to be rotatably received in the corresponding slit (126). Therefore, when the linkage (14) is connected with the holding bar (12), the pivotal movement of the holding bar (12) will consequently cause the linkage (14) to move up and down. The lever (15) has a through hole defined near one end thereof and to correspond to the first stud (132), such that after the first stud (132) is inserted into the through hole (151), one end of the lever (15) will engage with the bottom of the linkage (14) and the up and down movement of the linkage (14) will then cause the lever (15) to pivot. The second side bar (24) forms a bracket (243) corresponding to the free end of the lever (15). The bracket (243) defined therein is substantially U-shaped seat (242), so that the free end of the lever (15) is able to be detachable received in the seat (242). The driving block (17) defines therethrough an opening (172) corresponding to the stud (162) and the latch (18) securely engaged with the driving block (17) defines therethrough an elongate opening (182) for receiving therein a second spring (19) and corresponding to the second stud (134). Therefore, the second spring (19) compressibly received between an inner face of the elongate opening (182) and the second stud (134) is able to provide the latch (18) the necessary recovery force so as that after the latch (18) is pushed by the driving block (17), the recovery force of the second spring (19) will drive the latch (18) to return to its original position.

Figure 3:
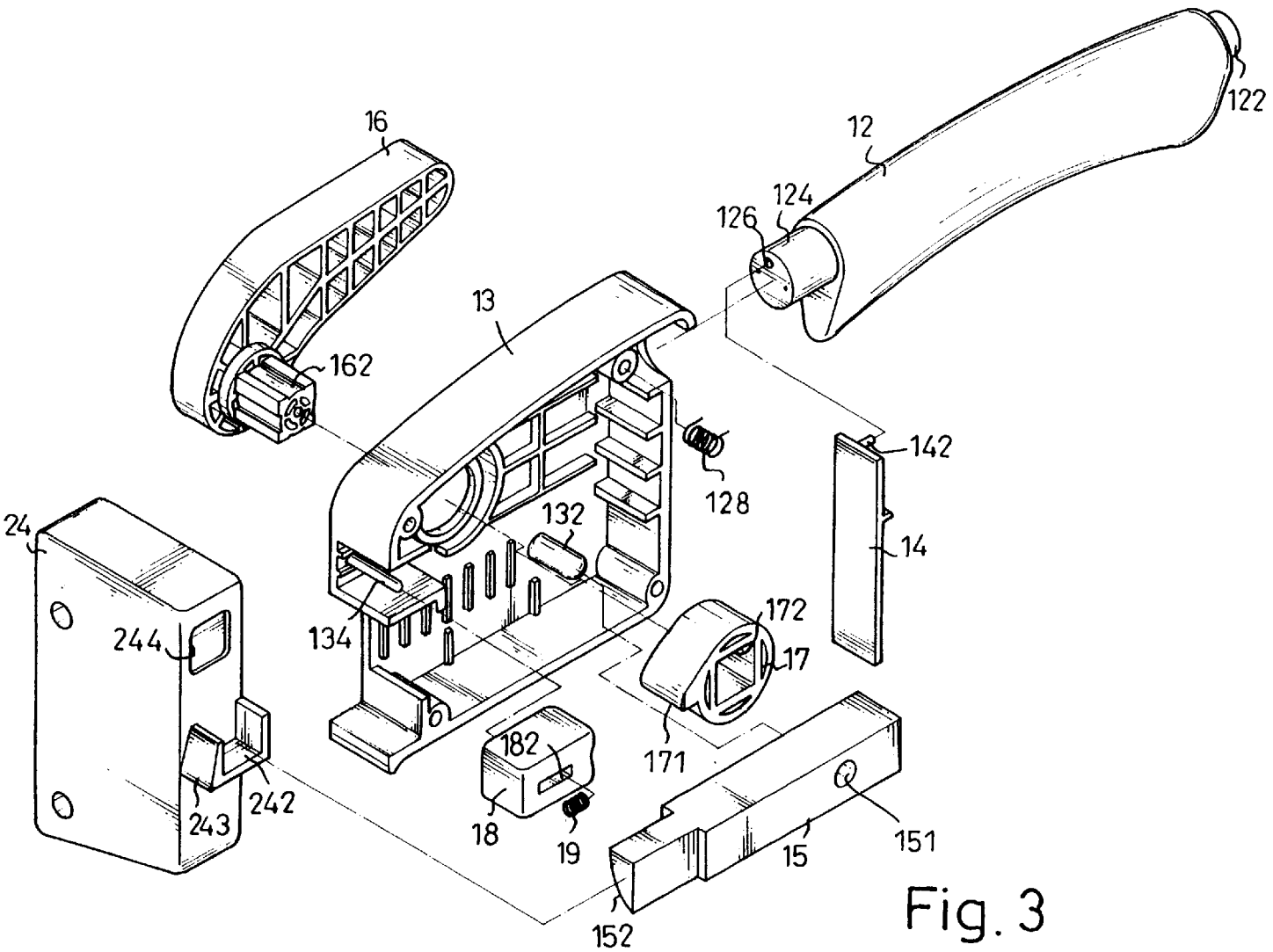
FIG. 3 is an exploded view of the lock used in the present invention.
Figure 4:
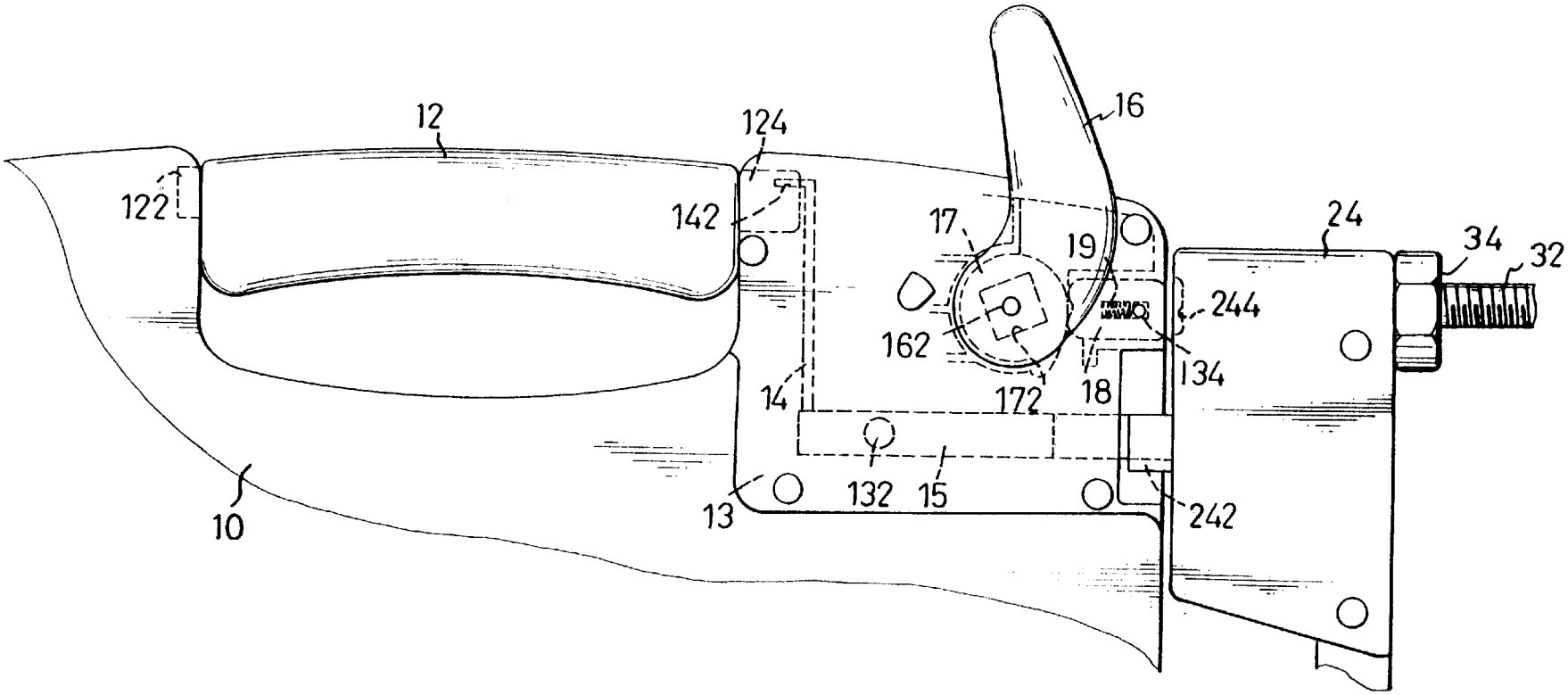
FIG. 4 is a plan view of the lock with the safety gate in accordance with the present invention.
Figure 5:
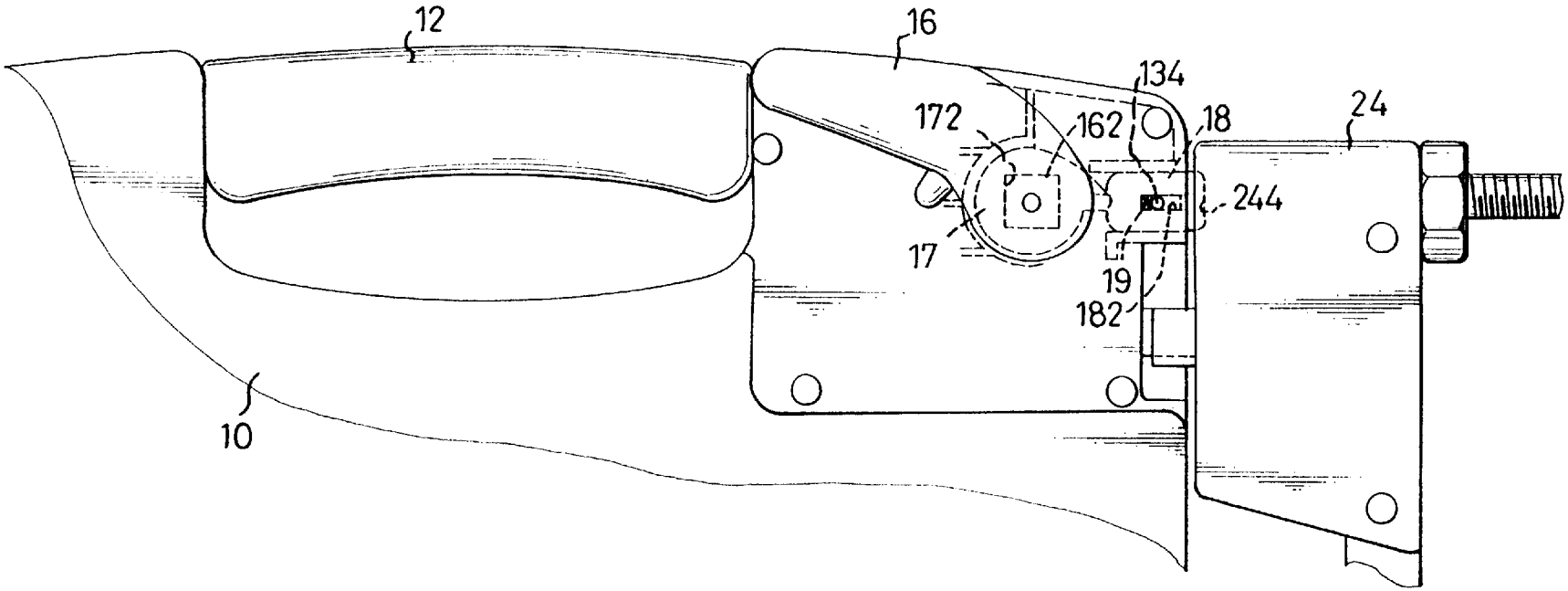
FIG. 5 is a plan view of the components of the lock in FIG. 3 when in a locked state.
Figure 6:
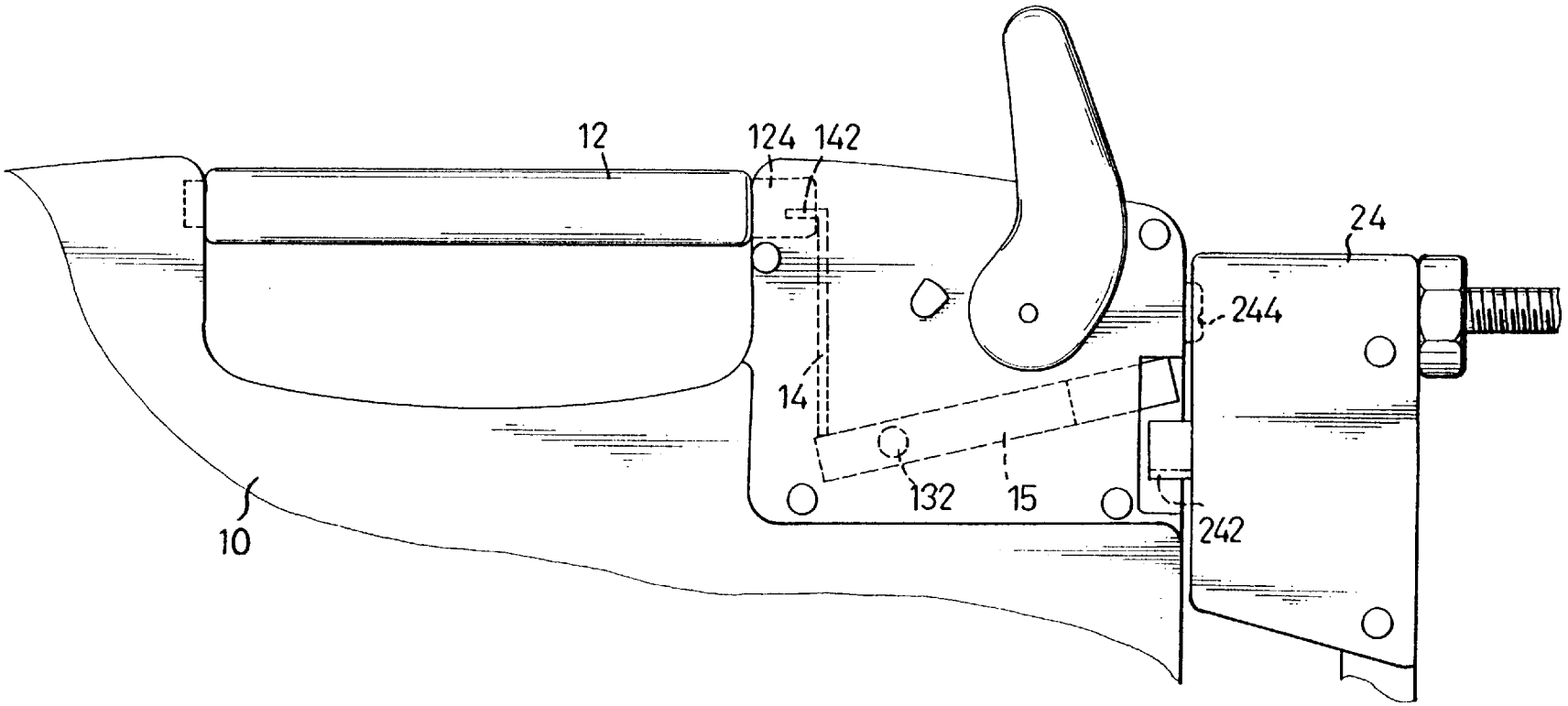
FIG. 6 is a plan view of the lock in FIG. 3 showing the disengagement of the linkage of the lock from a seat in a second side bar.

Referring to FIGS. 3, 4 and 5, when the lock in accordance with the invention is assembled and is in an unlock state, the latch (18) is still received in the housing (13) and the second spring (19) is not yet compressed. After the handle (16) is pivoted with respect to the housing (13), the driving block (17) will consequently be rotated by the pivotal movement of the handle (16). Thereafter, the head (171) extending from the driving block (17) will push the latch (18). Because of the push from the driving block (17), the latch (18) will move toward the recess (244) of the second side bar (24) as the elongate opening (182) moves along the second stud (134) and compresses the second spring (19). When the pivotal movement of the handle (16) stops, the driving block (17) still securely engage with the latch (18). Therefore, the latch (18) will be partially received in the recess (244) of the second side bar (24), which further locks the pivotal movement of the plate body (10) with respect to the base (20). However, when the handle (16) pivots in an opposite direction, the force on the latch (18) by the head (171) vanishes, and the latch (18) will return to its original unlocked position. That is, the latch (18) will leave the recess (244) and the locked relationship between the plate body (10) and the second side bar (24) is thus disengaged.

Furthermore, when referring to FIGS. 3, 6, 7 and 8, the pivotal movement of the holding bar (12) will trigger the up and down movement of the linkage (14). Because of the engagement between the linkage (14) and the lever (15), the lever (15) will then pivot with respect to the first stud (132). While the lever (15) pivots, the free end (152) of the lever (15) will then be detachably received in the seat (242) of the bracket (243). When the free end (152) of the lever (15) is received in the seat (242), the locked relationship between the plate body (10) and the second side bar (24) is secured. However, when the free end (152) of the lever (15) leaves the seat (242), the locked relationship therebetween vanishes. As mentioned before, the protrusion (11) formed on the bottom of the plate body (10) and the slot (202) defined in the base (20) for receiving the protrusion (11) are provided to prevent the relative movement of the plate body (10) to the base (20). Therefore, even if the locked relationship between the plate body (10) and the base (20) no longer exists by moving the latch (18) away from the recess (244) and the free end (152) away from the seat (242), the plate body (10) still cannot pivot with respect to the base (20). In this situation, after the lock device mounted in the plate body (10) is deactivated, the user still has to hold the holding bar (12) and lift it upward to separate the protrusion (11) from the slot (202), after which, the plate body (10) is thus pivotal with respect to the first side bar (22).

Figure 9:
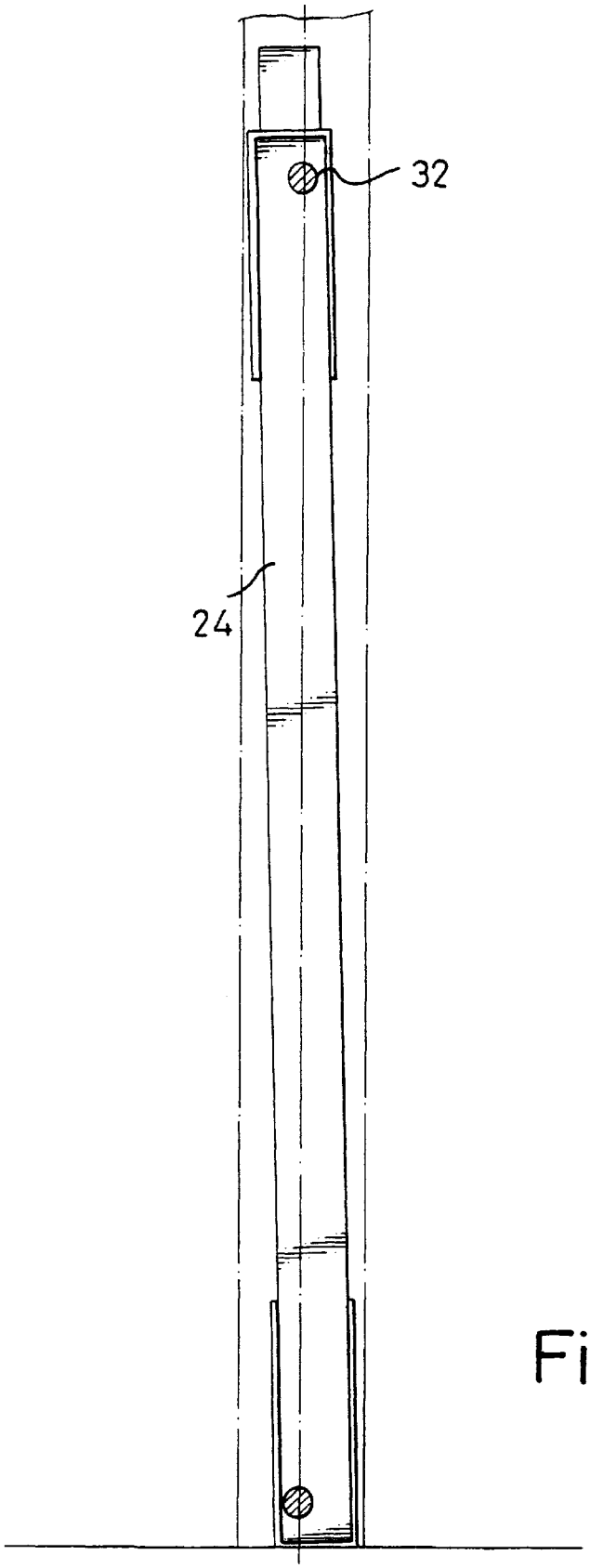
FIG. 9 is a view showing that the safety gate in accordance with the present invention is offset with respect to a doorframe.

Referring to FIG. 9, it is noted that the second side bar (24) is offset with respect to the doorframe (shown in dotted line), such that the plate body (10) tends to return to its closed position after it is opened by the user.

Figure 10:
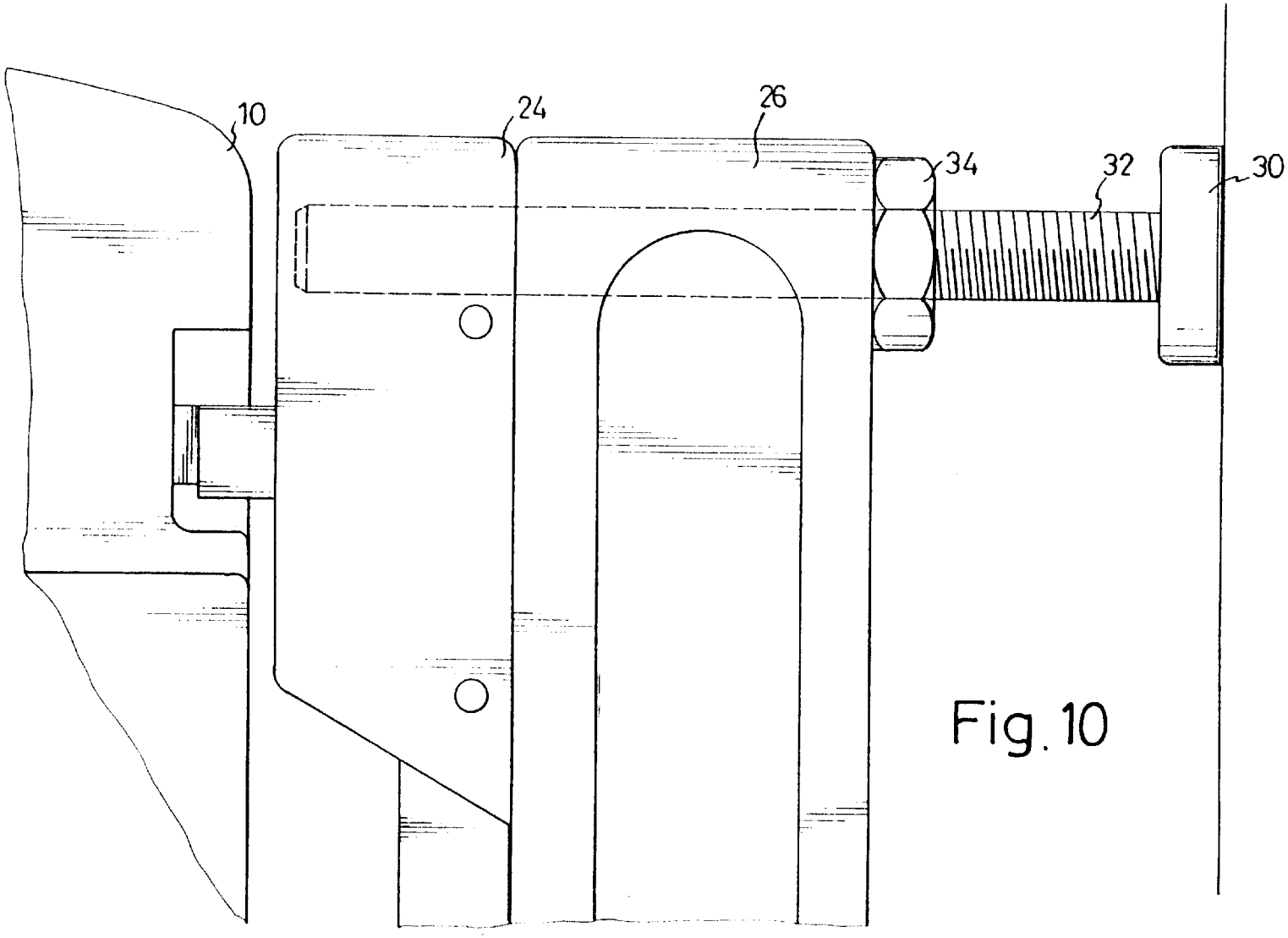
FIG. 10 is an enlarged view of FIG. 1 showing the engagement among the plate body, the second side bar and the expanding plate.
Figure 11:
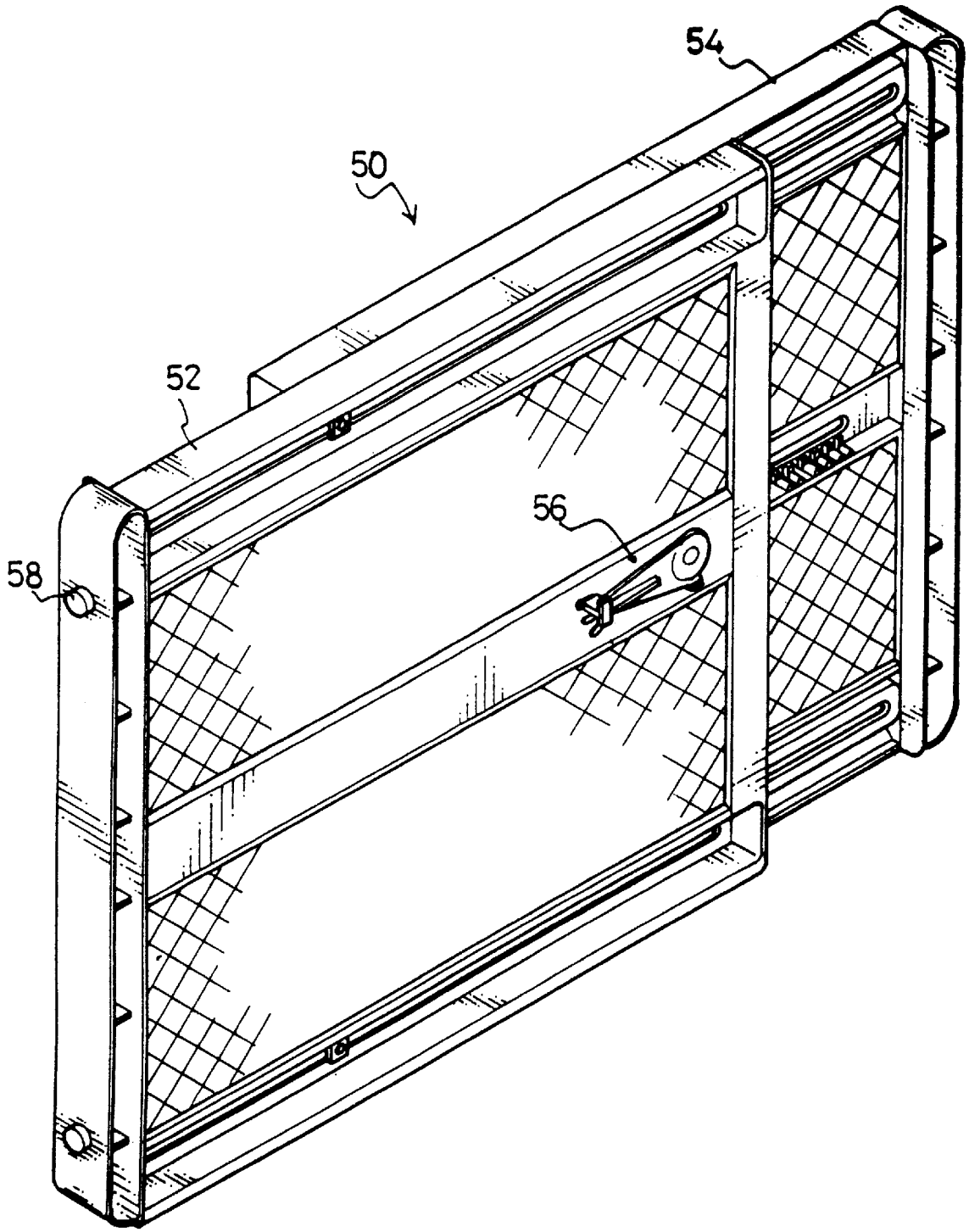
Fig 11 Prior Art
FIG. 11 is a perspective view showing a conventional safety gate.

Referring to FIGS. 1 and 10, when the width of a specific doorframe is too large and the safety gate of the invention is not able to fit therein, an expansion plate (26) is able to be added beside the second side bar (24). That is, to increase the width of the safety gate to be adapted to fit in an inordinately wide doorframe or archway.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A safety gate for a doorway, the safety gate comprising a plate body (10); a base (20) detachably connected with the plate body (10); a first side bar (22) pivotally connected with the plate body (10) and securely connected with the base (20); a second side bar (24) oppositely and detachably connected with the plate body (10) with respect to the first side bar (22); and two pairs of adjusting devices (30) each respectively mounted on the first and the second side bars (22, 24) so as to securely connect the first and the second side bars (22, 24) to the doorframe; wherein each adjusting device (30) has a bolt (32) inserted into the first and the second side bars (22, 24) and a nut (34) threadingly connected with the bolt (32), wherein the improvements comprise: a lock having:

a holding bar (12) having a first end (122) pivotally received in the plate body (10) and a second end (124);

a hollow housing (13) pivotally receiving the second end (124) of the holding bar (12) and provided with a first stud (132), a second stud (134) intergrally formed on an inner face thereof;

a linkage (14) connected with the second end (124) of the holding bar (12) to move up and down; and a lever (15) a first end of which engages with the linkage (14) and a second end of which is selectively and detachably limited by the second side bar (24).

2. The safety gate as claimed in claim 1, wherein the lock further has a handle (16) provide with a stud (162) pivotally extending into the housing (13);

a driving block (17) securely connected with the stud (162); and a latch (18) connected with the driving block (17) and detachably connected with the second side bar (24) and having an elongate opening (182) defined therein for receiving the second stud (134) therein.

3. The safety gate as claimed in claim 2, wherein the second side bar (24) has a recess (244) defined therein for detachably receiving the latch (18) therein.

4. The safety gate as claimed in claim 3, wherein the second end (124) of the holding bar (12) has a slit (126) defined therein and the linkage (14) has a key (142) formed to correspond to the slit (126) and a first spring (128) is stretched between the housing (13) and the second end (124) of the holding bar (12) so as to provide the holding bar (12) a recovery force when pivoted.

5. The safety gate as claimed in claim 3, wherein the lever (15) has a through hole (151) defined to correspond to the first stud (132) and a second spring (19) is compressed between the latch (18) and the second stud (134), such that the latch (18) is able to return to its original position after the force applied thereon is released.

6. The safety gate as claimed in claim 5, wherein the second side bar (24) further has bracket (243) with a seat (242) defined therein for detachably receiving the free end (152) of the lever (15).

7. The safety gate as claimed in claim 6, wherein the bracket (243) is substantially U shaped.

8. The safety gate as claimed in claim 3, wherein the latch (18) is movable with respect to the second stud (134).

9. The safety gate as claimed in claim 1, wherein the plate body (10) has a protrusion (11) formed on the bottom thereof and the base (20) defines a slot (202) corresponding to the protrusion (11), such that the protrusion (11) is able to be detachably received in the slot (202).

10. The safety gate as claimed in claim 9, wherein the plate body (10) has a pair of inclined faces (102, 104) formed on a side thereof and each of the inclined faces (102, 104) has a lug (103, 105) integrally extending therefrom; and wherein the first side bar (22) has a pair of inclined faces (222, 224) corresponding to the pair of inclined faces (102, 104) of the plate body (10) and each of the inclined faces (222, 224) defines therein a recess (223, 225) to correspond to one of the lugs (103, 105).

11. The safety gate as claimed in claim 10, wherein the location of the recesses (223,225) are so defined that after the corresponding lugs (103,105) are respectively received in the recesses (223,225), the safety gate is able to close automatically once it is opened.

12. The safety gate as claimed in claim 1, wherein an expanding plate (26) is detachably connected between the first side bar (22) and the second side bar (24), whereby the safety gate is able to accommodate different widths of doorframes.

* * * * *